US009611532B2

(12) United States Patent
Stong et al.

(10) Patent No.: US 9,611,532 B2
(45) Date of Patent: Apr. 4, 2017

(54) COATING ADDITIVE

(71) Applicant: Mahle International GmbH, Stuttgart (DE)

(72) Inventors: Thomas Stong, Kent City, MI (US); Thomas Smith, Muskegon, MI (US); Jason Bieneman, Brunswick, MI (US)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 13/935,163

(22) Filed: Jul. 3, 2013

(65) Prior Publication Data

US 2015/0010776 A1 Jan. 8, 2015

(51) Int. Cl.

| | |
|---|---|
| ***B22F 1/02*** | (2006.01) |
| ***C23C 4/10*** | (2016.01) |
| ***C23C 4/06*** | (2016.01) |
| ***C23C 4/129*** | (2016.01) |
| ***C23C 4/134*** | (2016.01) |

(52) U.S. Cl.

CPC ..... *C23C 4/10* (2013.01); *C23C 4/06* (2013.01); *C23C 4/129* (2016.01); *C23C 4/134* (2016.01); *Y10T 428/12771* (2015.01)

(58) Field of Classification Search

None

See application file for complete search history.

(56) References Cited

U.S. PATENT DOCUMENTS

| | | | | |
|---|---|---|---|---|
| 4,507,151 | A * | 3/1985 | Simm et al. | 75/255 |
| 4,596,282 | A | 6/1986 | Maddy et al. | |
| 4,612,256 | A * | 9/1986 | Neuhauser et al. | 428/547 |
| 4,863,661 | A | 9/1989 | Maddy | |
| 5,126,104 | A | 6/1992 | Anand et al. | |
| 5,292,382 | A | 3/1994 | Longo | |
| 5,618,590 | A | 4/1997 | Naruse et al. | |
| 5,641,580 | A * | 6/1997 | Sampath et al. | 428/663 |
| 6,060,182 | A * | 5/2000 | Tanaka et al. | 428/698 |
| 6,780,474 | B2 * | 8/2004 | Smith et al. | 427/456 |
| 6,833,165 | B2 | 12/2004 | Smith et al. | |
| 7,438,979 | B2 * | 10/2008 | Takayama et al. | 428/569 |
| 2008/0274010 | A1 * | 11/2008 | Jarosinski et al. | 420/588 |
| 2010/0127462 | A1 * | 5/2010 | Buchmann et al. | 277/444 |
| 2010/0203255 | A1 * | 8/2010 | Sherman | C23C 4/06 427/455 |
| 2011/0254230 | A1 * | 10/2011 | Jarosinski et al. | 277/444 |
| 2012/0180747 | A1 * | 7/2012 | Domanchuk et al. | 123/193.6 |

FOREIGN PATENT DOCUMENTS

| | | | | |
|---|---|---|---|---|
| GB | 1389726 | * | 4/1975 | C23C 7/00 |
| JP | 2005-114096 | * | 4/2005 | F16J 9/26 |

* cited by examiner

*Primary Examiner* — Humera Sheikh
*Assistant Examiner* — Seth Dumbris
(74) *Attorney, Agent, or Firm* — Fishman Stewart PLLC

(57) ABSTRACT

Various methods including applying a coating material with an additive to an article are disclosed. The coating material may be in a powder form before a thermal spraying used to apply the coating material. The coating material may comprise a chromium nitride, a chromium carbide, a chromium silicide, or a tungsten carbide. Additional materials may be added, e.g., a molybdenum alloy such as molybdenum-chromium. In one aspect, thermal spraying includes melting the coating material, propelling the molten coating material toward the article to be coated, and coating the article with the molten coating material. In another aspect, the coated article is one or more piston rings.

23 Claims, 6 Drawing Sheets

CrN/Ni - 40% MoCr

CrN/Ni

COATING ADDITIVE

BACKGROUND

A particular problem with known piston rings is that they are not sufficiently resistant to wear. Improved wear resistance has been accomplished through selection of piston ring base materials. In addition, increased wear resistance has been achieved by coating the piston ring base material with a material which has improved wear resistance as compared to the base material. Typical coatings including nitrides, carbides, chromium plating, and ceramic plating. However, known processes for applying these coating are expensive and time consuming.

For example, one known coating approach employs a physical vapor deposition method (PVD) of applying a coating material. PVD utilizes a vacuum chamber in which the coating material is evaporated. In one method, chromium metal cathodes are utilized. The cathodes are vaporized and the chromium becomes nitrided with the introduction of a quantity of nitrogen ions. An electrical potential passed through the articles to be coated ensures that the coating material is deposited on the articles. Although providing acceptable wear resistance, the process is expensive and complex. The PVD process involves long cycle times. It is also unable to provide a layer of coating material that is of sufficient thickness.

The reasons stated above illustrate the need for an improved method for creating wear resistant articles that is more economical, has a shorter cycle time and is capable of producing layers of coating materials that are of sufficient thickness in order to provided extended duty cycles.

BRIEF DESCRIPTION OF THE DRAWINGS

Referring now to the drawings, exemplary illustrations are shown in detail. Although the drawings represent some examples, the drawings are not necessarily to scale and certain features may be exaggerated, removed, or partially sectioned to better illustrate and explain the present invention. Further, the exemplary illustrations set forth herein are not intended to be exhaustive or otherwise limit or restrict the claims to the precise forms and configurations shown in the drawings and disclosed in the following detailed description:

DETAILED DESCRIPTION

Figure 1:
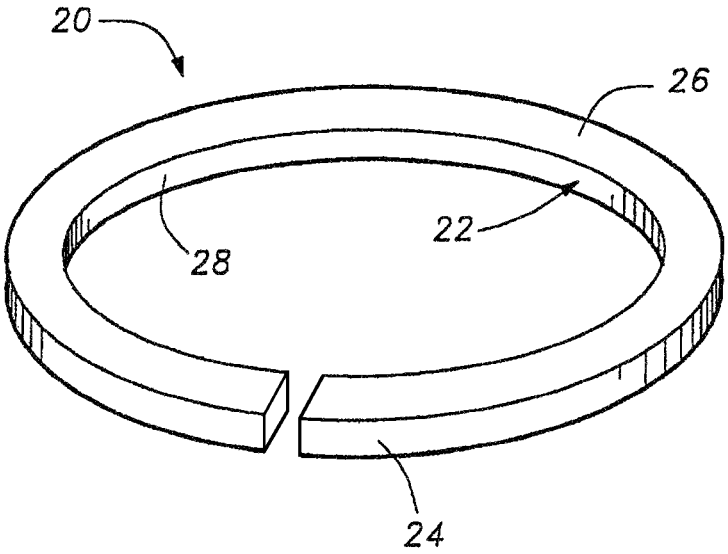
FIG. 1 shows a perspective view of a piston ring having a coating, according to an exemplary illustration.

Various exemplary illustrations of a coated article and methods of making the same are disclosed. An exemplary method may include applying a coating material on an article, e.g., a piston ring, a cylinder bore liner, a valve stem, or the like. The coating material may include a powder comprising one of chromium nitride, chromium carbide, tungsten carbide, chromium silicide, and an additive comprising a molybdenum alloy material. In one exemplary illustration, chromium nitride powder and a molybdenum-chrome alloy additive are thermally sprayed onto a surface of a piston ring.

The exemplary illustrations of a method for coating an article, e.g., a piston ring, engine bore surface, or the like, generally include applying a coating material to an article. In some exemplary approaches, a thermal spraying technique may be used to apply a coating material.

An exemplary coating material may have a base of any metal, alloy, compound or composition that is suitable for application, e.g., by thermal spraying. Suitable metals include chromium, molybdenum, nickel and/or cobalt, merely as examples. Exemplary compounds may combine metals with non-metals. In one example, compounds that combine nitride and carbide are employed as base coating materials. In a further exemplary illustration, a base coating material is a chromium nitride compound (CrN). Exemplary compositions include those that combine two different metal/non-metal compounds into one composition. In this aspect, exemplary compositions may combine chromium carbide (CrC), tungsten carbide (WC) and chromium silicide (CrSi).

Coating material may contain other, additional components such as metals and alloys. Useful additional components include, inter alia, molybdenum alloys, nickel-chromium (Ni—Cr) alloys and cobalt alloys. In one example, the base coating material is present in amounts of 20-80 wt % with the balance being any of the variety of additional components.

One useful coating material includes a Nickel cladded CrN as the base coating material and Mo—Cr alloy as an additional component. CrN may be present in amounts from about 20-80 wt % with the balance Mo—Cr alloy. One exemplary illustration of a coating material is about 60 wt % CrN and about 40 wt % Mo—Cr alloy. The Mo—Cr alloy may contain 15-55 wt % chromium.

Another useful coating material includes CrC, WC or CrSi as the base coating material and Mo—Cr alloy as an additional component. The CrC/WC/CrSi base coating material may be present in the amounts from about 50-99 wt % with the balance Mo—Cr alloy. The CrC/WC/CrSi base coating material includes 75-95 wt % chromium, 2-15 wt % silicon and 1-10 wt % carbon. In another exemplary illustration, the base coating material includes 85-90 wt % chromium, 7-10 wt % silicon and 3.5-5.0 wt % carbon. The Mo—Cr alloy includes 10-20 wt % chromium, 1-10 wt % iron, 3-6 wt % silicon, 1-5 wt % boron with the balance molybdenum. In another example, the Mo—Cr alloy includes 13-17 wt % chromium, 3-6 wt % iron, 4-5 wt % silicon and 2.75-3.5 wt % boron with the balance molybdenum. Yet another exemplary composition includes about 70 wt % CrC/WC/CrSi base coating material and about 30 wt % Mo—Cr alloy.

Figure 2A:
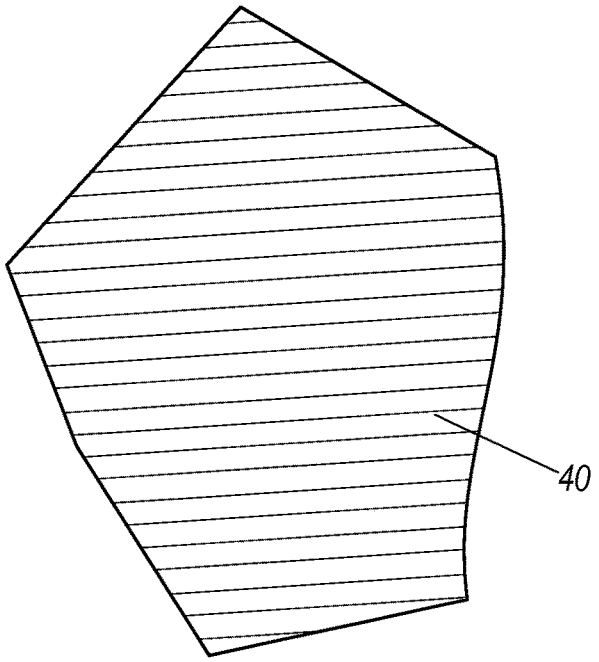
FIG. 2A shows an enlarged view of an exemplary particle prior to cladding, according to one exemplary approach.
Figure 2B:
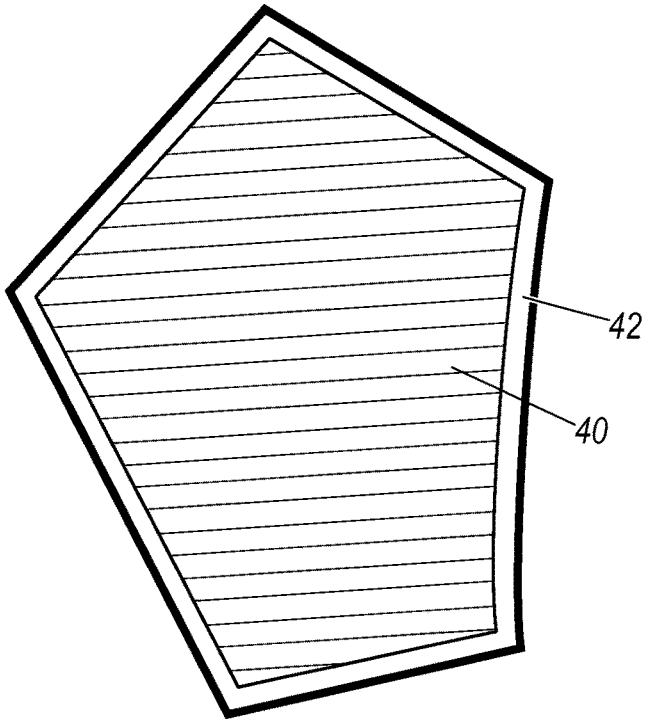
FIG. 2B also shows an exemplary particle after cladding, according to another exemplary illustration.

In one exemplary approach, an exemplary coating material includes a Nickel cladded powder material. Turning now to FIGS. 2A and 2B, an exemplary cladded powder material may comprise a plurality of powder particles generally including a chrome-nitride core 40 and an outer layer 42, which may be formed of nickel. In another exemplary approach, the core 40 may be formed of an inner core formed of a $Cr_2N$ material and an outer core portion formed of CrN, with the outer core portion disposed about the $Cr_2N$ inner core. The outer layer 42 may be a nickel cladding which generally forms an outer layer about the CrN core. In one exemplary approach, a cladded powder coating material may be formed using a nitriding process. For example, the exemplary powder coating material shown in FIGS. 2A and 2B may be formed from a $Cr_2N$ powder by nitriding the $Cr_2N$ powder, thereby forming an intermediate CrN layer which cooperates with the inner Cr2N material to form the core 40, and an outer nickel layer which forms the outer layer 42.

A cladding layer may generally inhibit oxidation of the powder particles during spray application. More specifically, the cladding layer generally prevents the inner core 40, e.g., chromium nitride, from coming into intimate contact with oxygen in the high temperature spray environment, advantageously resulting in higher levels of retained nitrides.

In some exemplary approaches, an additive is used in combination with the exemplary cladded powder. The use of an additive increased scuff resistance of the resulting coating layers formed with the cladded powder material. A molybdenum-chrome ("moly-chrome") additive material is employed in one exemplary illustration. In one example, a coating layer formed with a CrN/Ni base cladded powder in combination with a molybdenum-chrome material resulted in a surprisingly large improvement in scuff resistance on a piston ring surface coated with the cladded powder material. Moreover, scuff resistance of the coating material was equivalent to chrome-nitride coatings applied by physical vapor deposition.

The molybdenum alloy may have any composition that is convenient. Merely by way of example, molybdenum may be alloyed with any of chromium, carbon, silicon, nickel, tungsten, iron, cobalt, boron, or nitrogen. In examples where the molybdenum is alloyed with chromium, an exemplary moly-chrome additive may have any amount of molybdenum and chrome that is convenient. In one exemplary illustration, the additive may be 65% wt molybdenum and 35% wt chrome. Moreover, the additive may be combined with the CrN cladded powder in any relative amount that is convenient. In one exemplary approach, a coating material is 40% wt moly-chrome additive, and 60% CrN cladded powder.

Figure 3:
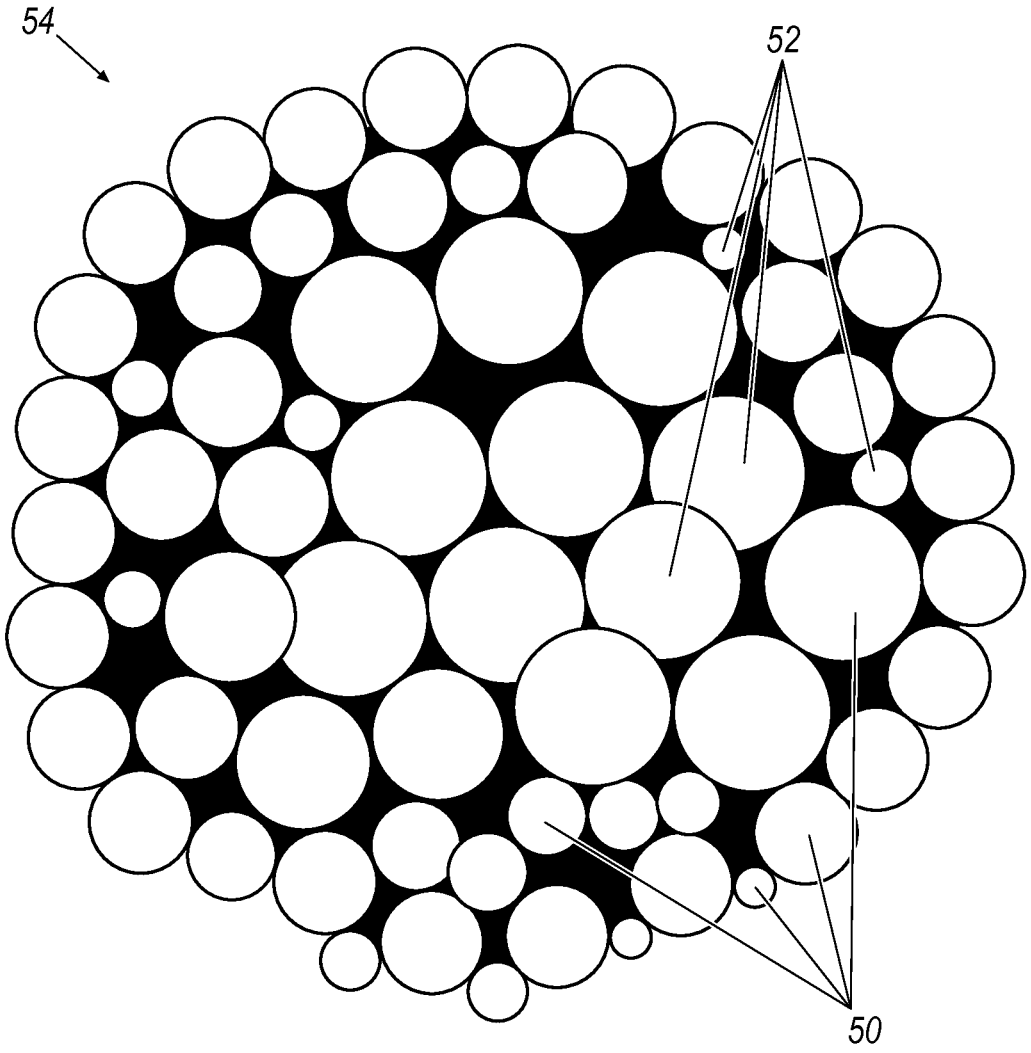
FIG. 3 shows an enlarged view of an exemplary agglomerated and sintered powder.

The moly-chrome additive may be formed in any process that is convenient. In one example, a moly-chrome additive may be formed using an agglomeration and sintering process. In other exemplary approaches, crushing, gas atomization, water atomization, or plasma densification may be used to form exemplary moly-chrome powder materials which may be used as an additive to a cladded powder material. As seen in FIG. 3, an agglomerated and sintered particle 54 may be comprised substantially entirely of molybdenum and chromium particles. Each of the molybdenum particles 50 and the chromium particles 52 may be approximately 2-10 μm in size. As a result of the agglomeration process. The particle 54 may, in one exemplary illustration, be approximately 35-40 μm in size. Addition of chromium to the molybdenum generally lowers the melting temperature of the alloy which aids in the coating spray process. In addition the chromium imparts higher hardness, wear resistance and corrosion resistance as compared to conventional Molybdenum and Molybdenum-Carbon.

The size, shape and composition of the article being coated are not critical to the exemplary illustrations, and as such exemplary coatings may be applied to rings, bore surfaces, valve stems, or any other metallic sliding surface generally without limitation. In one exemplary illustration, an exemplary coating is applied to a piston ring, e.g., as seen in FIG. 1. More specifically, an exemplary split piston ring 20 may have an outer surface 22 that includes an outer peripheral face 24, an upper axial surface 24 and a lower axial surface 28. In use, outer peripheral face 24 contacts an inner wall of a cylinder bore (not shown).

The disclosed coating materials may be thermally sprayed onto an article. Thermal spraying is a process that deposits a coating onto an article and includes propelling a melted coating material to the article. Specifically, in a heat source the coating material becomes molten. The molten coating material is carried in a gas stream to the article to be coated where the coating material contacts the article. The molten coating material may have a particle size in the range of 5-80 μm.

Figure 5:
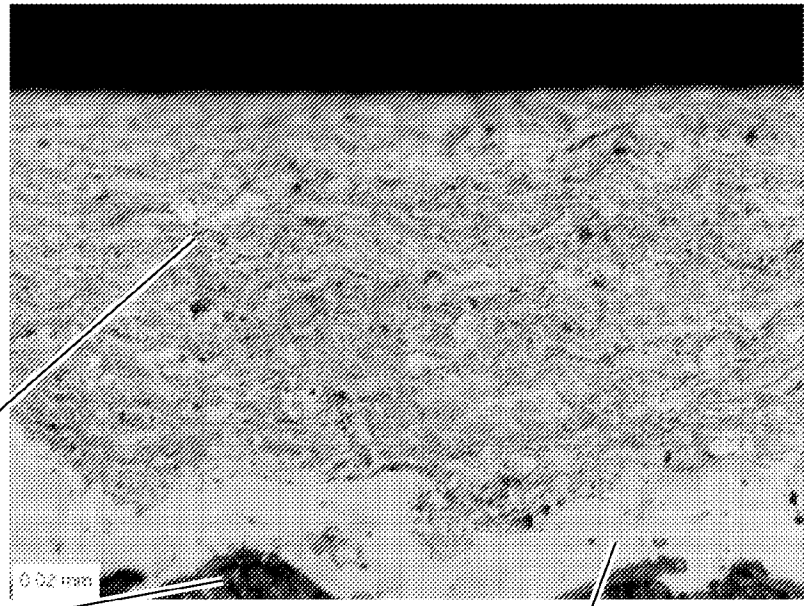
FIG. 5 shows an enlarged view of the exemplary coating layer of FIG. 4, as viewed with an optical microscope.
Figure 4:
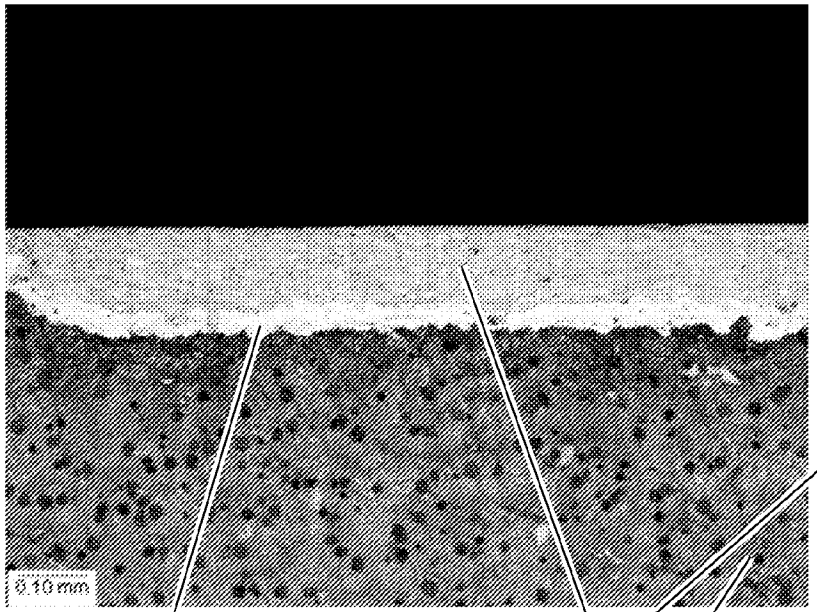
FIG. 4 shows an enlarged view of an exemplary coating layer formed with the applied powders of FIG. 2 and FIG. 3, as viewed with an optical microscope.
Figures 6, 7:
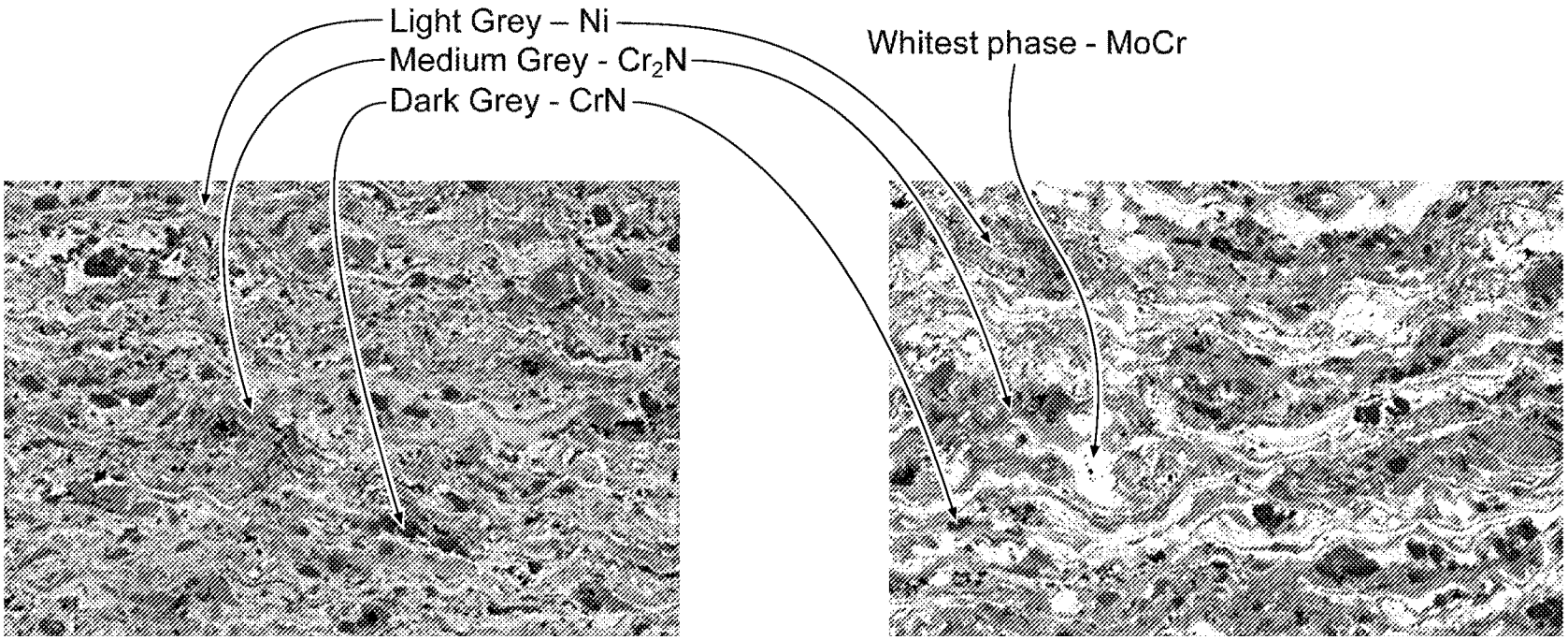
FIG. 6 shows an enlarged view of a coating layer with a cladded powder composition, as viewed with a scanning electron microscope (SEM)
FIG. 7 shows an enlarged view of a coating layer with a cladded power blended with the agglomerated and sintered powder, as viewed with a scanning electron microscope (SEM).

Turning now to FIGS. 4, 5, and 7, exemplary coating layers are described in further detail. FIG. 4 illustrates a base material 30, e.g., a ferrous piston ring substrate, having an exemplary coating layer 34 applied to a surface thereof. The coating layer 34 may be applied over a bond coating 32 interposed between the coating layer 34 and base material 30. Moreover, in one exemplary illustration the bond coating 32 may be formed as a byproduct of a coating application process associated with the coating layer 34. For example, a CrN powder material, as described above, may be applied in a thermal spraying process that forms a chrome material layer as the bond coating 32 as a result of the thermal spraying process of the CrN material.

Turning now to FIG. 7, an enlarged view of a coating layer applied with a CrN material along with a 40% wt molybdenum-chrome additive is illustrated. The molybdenum-chrome material (white material) is generally interspersed throughout the CrN material, which is shown in its CrN (dark grey) and Cr2N (medium grey) components, along with the nickel cladding material (light grey). By contrast, in FIG. 6 a CrN coating layer is shown without a molybdenum-chrome additive.

Thermal spraying exhibits several advantages over PVD. The equipment is comparatively less expensive to purchase and easier to operate. The cycle time is relatively short, meaning that more articles may be coated quicker. Thermal spraying also allows coating materials to be applied evenly over the entire article. Some exemplary coating thicknesses are in the range of 50-400 μm. However, the thickness of the applied coating is also comparatively unlimited and may be on the order of 400 μm or more. Such a high level of thickness allows the article to be processed after coating without risking the overall integrity of the coating material. For example, the article may be, inter alia, fused, honed, ground, shaped or polished.

Any thermal spraying process may be used in conjunction with the exemplary illustrations. While processes that employ a powdered coating material are preferred, processes that employ wire coating materials may also be suitable. For example, a gas combustion/wire process continuously feeds a wire of the coating material into a nozzle. A fuel gas, e.g., acetylene or propane, is mixed with oxygen and burned to produce a flame in the nozzle at the tip of the wire. The wire consequently melts and is atomized. The molten coating material is propelled to the article by a carrier gas, e.g., compressed air. Two wire electric arc processes may also be utilized.

In a gas combustion/powder process, the coating material, in the form of a powder, is aspirated into a fuel and oxygen flame. The molten coating material is propelled to the article by the hot gases, i.e., the aspirating gas and the by product gases of combustion. Although the flame temperature may reach 3000° C., the article being coated rarely reaches a temperature of greater than 150° C.

One preferred process is a high-velocity oxy-fuel (HVOF) process in which a gun-like barrel is filled with a measured amount of powdered coating material, fuel gas, and oxygen. The mixture is ignited by a spark. The heat of the explosion melts the coating material and the expanding gases propel the molten material to the article. Numerous different devices that carry out HVOF process are available on the market, including those from Praxair, Inc.

Another exemplary process is a plasma/powder process in which a gas, e.g. an argon/hydrogen mixture, an argon/nitrogen mixture, a nitrogen/helium mixture or an argon/helium mixture, is passed through a sustained electric arc. The electric arc is typically created between a tungsten cathode and a concentric copper anode that form a chamber through which the gas is passed. The electric arc creates a plasma flame. The powder coating material is injected into the plasma flame, which melts and propels the coating material to the article.

Oxidation of the coating material may cause lower quality coatings. Oxidation occurs primarily in the time period between the time the coating material is melted and the time the coating material contacts the article to be coated. This may also be termed the flight time. Minimization of the flight time minimizes oxidation. Minimizing the flight time can be accomplished by decreasing the distance to the article to be coated. For example, standard placement of the articles is about 3.5 inches from the heat source of the thermal sprayer. Moving the article even a half inch closer to the heat source will decrease the amount of oxidation. In one exemplary illustration, the article is moved so that it is about 2.5 inches from the heat source of the thermal sprayer. In a HVOF process, the length of the barrel may be shortened, thus effectively reducing the flight time and the oxidation of the coating material.

In thermal spraying processes that utilize a primary arc gas, flight time and oxidation can be decreased by increasing flow rate of the primary arc gas. In a plasma process, increasing the flow rate of the plasma can be accomplished by using a greater volume of gas in a given time period, increasing the voltage and/or the amperage used to create the electric arc, and/or using different gas mixture to generate the plasma flame. For example, typically gas is used at a volume of around 100 standard cubic feet/hour (cfh). Increasing the volume of gas to more than 200 cfh will decrease oxidation. Increasing the voltage and amperage from the typical 30 volts and 600 amps to 50-70 volts and 800-1000 amps has the effect of decreasing oxidation. In one exemplary approach, a voltage of about 60 volts is used in combination with amperage of about 900 amps. Indeed, a gas of argon and helium allows less oxidation than a gas of argon and hydrogen. In a preferred method, an argon/helium gas is used at a volume of 200 cfh of argon and a volume of 30 cfh helium. Obviously, using more than one of these techniques may have a synergistic effect on the reduction of oxidation of the coating material.

Figure 8:
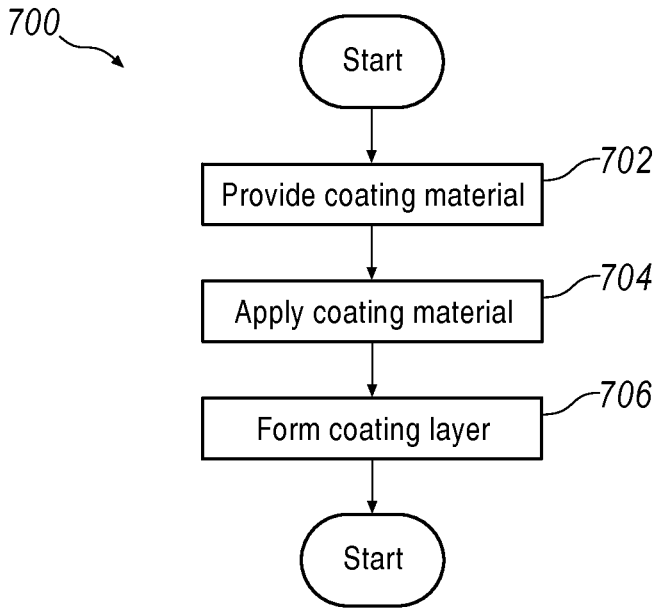
FIG. 8 shows a process flow diagram for an exemplary method of coating an article.

Turning now to FIG. 8, an exemplary process 700 for coating an article is described. Process 700 may begin at block 702, where a coating material is provided. For example, a coating material may include a cladded powder material and an additive, e.g., a chrome-nitride powder material where the powder particles are cladded in a nickel material. Moreover, an additive may be used as part of the powder coating material. Merely as an example, as noted above a molybdenum-chrome material may be used as an additive in any amount that is convenient. In one exemplary illustration, the molybdenum-chrome additive is between about 20% and 80% by weight of the coating material.

Proceeding to block 704, the coating material may be applied, e.g., to a metallic sliding or bearing surface. For example, as noted above a powder coating material may be applied to a piston ring surface. Exemplary coating materials may be applied in any manner that is convenient. For example, as described above a thermal spraying process, e.g., HVOF, may be used to apply the coating material. Process 700 may then proceed to block 706.

At block 706, a coating layer may be formed on a substrate. For example, coating layers as illustrated above in FIGS. 3, 4, and 6 may be formed using a thermal spraying process applying a powder coating material. As noted above, exemplary coating thicknesses may be in the range of 50-400 μm. Moreover, some exemplary coatings may be on the order of 400 μm or more.

As used in this application, "melt" and "molten" and their word forms are to be construed broadly. These words describe situations where the coating material makes a complete phase change from solid to liquid as well as situations where only a partial phase change occurs in the coating material. For example, the coating material may only be softened or plasticized in the heating or melting step of the thermal spraying process. "Melt" and "molten" should be construed to include any situation where the coating material is just soft enough to adhere to itself and to the article to be coated.

Furthermore, as used in this application, chromium nitride, CrN, chromium carbide, CrC, chromium silicide and CrSi are to be construed broadly. These words and abbreviations are used as shorthand for a range compounds where the ratio of component atoms are not necessarily one to one. For example, CrN may denote $Cr_1N_1$ as well as $Cr_2N_1$ and chromium silicide may denote $Cr_1Si_1$ as well as $Cr_3Si_1$. Indeed, any ratio of component atoms may be used.

Reference in the specification to "one example," "an example," "one embodiment," or "an embodiment" means that a particular feature, structure, or characteristic described in connection with the example is included in at least one example. The phrase "in one example" in various places in the specification does not necessarily refer to the same example each time it appears.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary in made herein. In particular, use of the singular articles such as "a," "the," "the," etc. should be read to recite one or more of the indicated elements unless a claim recites an explicit limitation to the contrary.

What is claimed is:

1. A coated article, comprising:

a metallic substrate; and a coating layer on an outer surface of the substrate, the coating layer having a chromium nitride material and an additive of a molybdenum-chromium alloy;

wherein the chromium nitride material is formed from a plurality of powder particles each having a core and an outer nickel layer, the core being formed from an intermediate layer of CrN cooperating with a $Cr_2N$ powder particle.

2. The coated article of claim 1, wherein the metallic substrate is a piston ring comprising an annular body.

3. The coated article of claim 2, wherein the coating layer is applied to a radially outer periphery of the annular body.

4. The coated article of claim 1, wherein the coating layer is thermally sprayed onto the metallic substrate.

5. The coated article of claim 1, wherein the coating layer comprises about 60% wt chromium nitride, and about 40% wt molybdenum-chromium.

6. The coated article of claim 1, wherein the coating layer is about 50-90 wt % chromium nitride.

7. The coated article of claim 6, wherein the coating layer is about 70 wt % chromium nitride.

8. The coated article of claim 1, wherein the coating layer defines a typical coating thickness of 150 μm.

9. The coated article of claim 1, wherein the coating layer is at least 20% wt molybdenum chromium.

10. The coated article of claim 9, wherein the coating layer is no more than 80% wt molybdenum chromium.

11. The coated article of claim 9, wherein the coating layer comprises an agglomerated and sintered molybdenum-chromium material.

12. The coated article according to claim 1, wherein the molybdenum-chromium alloy powder contains 15-55 wt. % chromium.

13. The coated article according to claim 1, wherein the molybdenum-chromium alloy powder comprises 65 wt. % molybdenum and 35 wt. % chromium.

14. The coated article according to claim 1, wherein the molybdenum-chromium alloy is interspersed throughout the chromium nitride material.

15. A piston ring comprising an annular body having an outer radial periphery, the outer radial periphery having a wear resistant coating having a chromium nitride material and an additive of a molybdenum-chromium alloy, wherein the chromium nitride material is formed from a plurality of powder particles each having a core and an outer nickel layer applied with the additive by thermal spray deposition, the wear resistant coating comprising about 60 wt % chromium nitride and about 40 wt % molybdenum chromium alloy;

a coating layer on an outer surface of the substrate, the coating layer having a chromium nitride material and an additive of a molybdenum-chromium alloy;

wherein the chromium nitride material is formed from a plurality of powder particles each having a core and an outer nickel layer, the core being formed from an intermediate layer of CrN cooperating with a $Cr_2N$ powder particle.

16. The piston ring according to claim 15, wherein the molybdenum-chromium alloy powder contains 15-55 wt. % chromium.

17. The piston ring according to claim 15, wherein the molybdenum-chromium alloy powder comprises 65 wt. % molybdenum and 35 wt. % chromium.

18. A wear resistant coating for protecting a surface, comprising:

a material of one of chromium nitride, chromium carbide, tungsten carbide, and chromium silicide; and an additive of a molybdenum-chromium alloy;

wherein the material is formed from a powder, the particles of which each has a core and an outer nickel layer, the core being formed from an intermediate layer of CrN cooperating with a $Cr_2N$ powder particle, the powder being applied with the additive in the form of a molybdenum-chromium alloy powder by thermal spraying.

19. The wear resistant coating of claim 18, wherein the powder comprises about 60 wt % chromium nitride, and about 40 wt % molybdenum-chromium alloy powder.

20. The wear resistant coating of claim 18, wherein the powder comprises chromium nitride powder and a molybdenum-chromium alloy powder.

21. The wear resistant coating of claim 20, wherein the powder comprises between 20 and 80% wt chromium nitride, and between 80 and 20% wt molybdenum-chromium alloy powder.

22. The wear resistant coating according to claim 18, wherein the molybdenum-chromium alloy powder contains 15-55 wt. % chromium.

23. The wear resistant coating according to claim 18, wherein the molybdenum-chromium alloy powder comprises 65 wt. % molybdenum and 35 wt. % chromium.

* * * * *